US007714811B2

(12) United States Patent
Kim

(10) Patent No.: US 7,714,811 B2
(45) Date of Patent: May 11, 2010

(54) LIGHT-EMITTING DEVICE AND METHOD OF DRIVING THE SAME

(75) Inventor: Ji Hun Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 1065 days.

(21) Appl. No.: 11/352,332

(22) Filed: Feb. 13, 2006

(65) Prior Publication Data

US 2007/0057628 A1 Mar. 15, 2007

(30) Foreign Application Priority Data

Sep. 12, 2005 (KR) ..... 10-2005-0084682
Oct. 13, 2005 (KR) ..... 10-2005-0096537

(51) Int. Cl.
*G09G 3/30* (2006.01)

(52) U.S. Cl. ..... 345/76

(58) Field of Classification Search ..... 345/76–82; 315/169.3

See application file for complete search history.

(56) References Cited

U.S. PATENT DOCUMENTS 7,079,092 B2 * 7/2006 Tanghe et al. ..... 345/76
7,167,406 B2 * 1/2007 Komiya ..... 365/203
7,180,245 B2 * 2/2007 Yamazaki et al. ..... 315/169.3
7,501,999 B2 * 3/2009 Shin ..... 345/76
2002/0167474 A1 11/2002 Everitt
2002/0167478 A1 * 11/2002 LeChevalier ..... 345/98
2003/0058199 A1 * 3/2003 Kasai ..... 345/76
2003/0059525 A1 3/2003 Moon
2003/0169219 A1 9/2003 LeChevalier
2004/0060279 A1 * 4/2004 Joseph et al. ..... 60/226.1
2004/0080279 A1 * 4/2004 Maede et al. ..... 315/169.3
2005/0146281 A1 7/2005 Ng et al.

FOREIGN PATENT DOCUMENTS

CN 1617204 5/2005

OTHER PUBLICATIONS

Chinese Office Action dated Jun. 6, 2008.
European Search Report dated Nov. 30, 2009.

* cited by examiner

*Primary Examiner*—Richard Hjerpe
*Assistant Examiner*—Carolyn R Edwards
(74) *Attorney, Agent, or Firm*—Ked & Associates LLP

(57) ABSTRACT

A light-emitting device avoids a cross-talk phenomenon. The device includes a precharge controlling circuit and a precharge circuit. The precharge controlling circuit provides a precharge controlling signal in accordance with display data input from an external source. The precharge circuit applies a precharge current corresponding to display data and a scan line resistance to the data lines in accordance with the precharge controlling signal transmitted from the precharge controlling circuit. As a result, precharge current is applied to data lines according to a pixel cathode voltage, and thus cross-talk occurs is eliminated or at least substantially reduced in the device.

18 Claims, 16 Drawing Sheets

LIGHT-EMITTING DEVICE AND METHOD OF DRIVING THE SAME

BACKGROUND OF THE INVENTION

1. Field of the Invention

The present invention generally relates to light-emitting devices, and more particularly to an electroluminescent device and a method of driving the same.

2. Description of the Related Art

FIG. 1 shows a first related-art organic electroluminescent device. This device includes a panel 100, a controlling circuit 102, a scan driving circuit 104, a discharge circuit 106, a precharge circuit 108, and a data driving circuit 110.

The panel 100 includes a plurality of sub-pixels (E11 to E44) formed in an area of crossed data lines (D1 to D4) and scan lines (S1 to S4). Each sub-pixel corresponds to a red sub-pixel, a green sub-pixel, or a blue sub-pixel, and each pixel comprises red, green, and blue (RGB) sub-pixels.

The controlling circuit 102 receives display data input from an external source. The display data may, for example, be RGB data. Circuit 102 controls operation of the elements in the organic electroluminescent device by using the received display data. The scan driving circuit 104 is formed in one direction of the panel 100, and transmits in sequence scan signals to the scan lines (S1 to S4).

The discharge circuit 106 includes a switch (SW) and a zener diode (ZD). The switch (SW) is turned on or off by a control signal from the controlling circuit 102. For example, when the data lines (D1 to D4) are discharged, the switch (SW) is turned on. As a result, the data lines (D1 to D4) are connected to the zener diode ZD, and a charge on the data lines (D1 to D4) is discharged up to a zener voltage of the zener diode (ZD).

The precharge circuit 108 applies a precharge current corresponding to the display data to the data lines (D1 to D4) in accordance with control of the controlling circuit 102. The data driving circuit 110 applies a data current corresponding to the display data to the data lines (D1 to D4) in accordance with control of the controlling circuit 102.

FIG. 2A and FIG. 2B show circuits for driving the organic electroluminescent device of FIG. 1, FIG. 2C is a timing diagram showing how the pixels of FIG. 2A and FIG. 2B are controlled to emit light. A first resistance (RS) between the outmost sub-pixel and ground has a value of 10Ω. A second resistor (RP) between sub-pixels has a value of 2Ω. Moreover, each of pixel (E41) and pixel (E42) emits light having a brightness corresponding to the data current of 3 amps. Further, sub-pixels (E11, E21 and E31) do not emit light. In addition, each of sub-pixels (E12, E22 and E32) emit light having a brightness corresponding to the data current of 1 amp.

To cause sub-pixels E11 to E41 along scan line S1 to emit light, precharge circuit 108 applies a precharge current corresponding to the display data to the E11 to E41 sub-pixels. (See FIG. 2A.) As a result, a charge corresponding to a second voltage (V2, default precharge voltage) is precharged to the E41 sub-pixel during a first precharge time (pcha1), as shown in FIG. 2C.

Subsequently, data currents (I11 to I41), which are 0, 0, 0, and 3 amps respectively, are applied to the data lines (D1 to D4). In this case, an anode voltage (VA41) of the E41 sub-pixel is increased up to a third voltage (V3), corresponding to the sum of a cathode voltage (VC41) and a voltage of 4V corresponding to a data current of 3 amps during T1 time. Then, the anode voltage (VA41) reaches a stable third voltage (V3) after a certain time. Here, the cathode voltage (VC41) is the whole current (sum of 0, 0, 0 and 3 amps) passing through the first scan line (S1) times a resistor of the scan line (sum of 10, 2, 2 and 2Ω), i.e. 48V, and thus V3 is 52V. Accordingly, the E41 sub-pixel emits a light having gray scale corresponding to 4V, i.e., the difference between the anode voltage (VA41) and the cathode voltage (VC41).

As shown in FIG. 2B, the precharge circuit 108 applies a precharge current corresponding to the display data to the E12 to E42 sub-pixels. As a result, a charge corresponding to the second voltage (V2, default precharge voltage) is precharged to the E42 sub-pixel during a second precharge time (pcha2), as further shown in FIG. 2C.

Subsequently, data currents (I12 to I42), which respectively correspond to 1, 1, 1, and 3 amps, are applied to data lines (D1 to D4). In this case, an anode voltage (VA42) of the E42 pixel is increased up to a fourth voltage (V4) corresponding to the sum of a cathode voltage (VC42) and the voltage of 4V corresponding to the data current of 3 amps during T2 time. Then, the anode voltage (VA42) reaches a stable fourth voltage (V4) after a certain time. Here, the cathode voltage (VC42) is the whole current (sum of 1, 1, 1 and 3 amps passing through the second scan line (S2) times the resistor of the scan line (sum of 10, 2, 2 and 2Ω), i.e. 96V, and thus V4 is 100V.

In summary, the difference of the stabilized anode voltage (VA42) of the E42 sub-pixel and the precharge voltage (V2) is higher than that of the stabilized anode voltage (VA41) and the precharge voltage (V2). Hence, T2 is bigger than T1. As a result, the consumed amount of charge to stabilize anode voltage (VA42) in the E42 sub-pixel is higher than is required to stabilize anode voltage (VA41) in the E41 sub-pixel, as shown in FIG. 2C. Accordingly, the E42 sub-pixel is designed to emit light at the same gray scale level as the E41 sub-pixel, but in reality emits light having a gray scale level smaller than the E41 sub-pixel. This phenomenon is often referred to as a cross-talk phenomenon.

FIG. 3 shows a second related-art organic electroluminescent device. This device includes a panel 300, a controlling circuit 302, a first scan driving circuit 304, a second scan driving circuit 306, a discharge circuit (e.g., a circuit to ground), a precharge circuit 310, and a data driving circuit 312. (Since the elements of this embodiment except the first scan driving circuit 304 and the second scan driving circuit 306 are the same as those of the first embodiment, any further detailed descriptions concerning the same elements will be omitted.)

The first scan driving circuit 304 transmits first scan signals to one group of scan lines (S1 and S3) in one direction of the panel. The second driving circuit 306 transmits second scan signals to remaining ones of the scan lines (S2 and S4) in other direction of the panel. As in the first related-art organic electroluminescent device, the cross-talk phenomenon occurs in the second related-art organic electroluminescent device. Also, the light-emitting process in the second device is similar to the device, and thus any further detailed descriptions concerning the process will be omitted.

SUMMARY OF THE INVENTION

An object of the invention is to solve at least the above problems and/or disadvantages and to provide at least the advantages described hereinafter Another object of the present invention is to prevent cross-talk.

These and other objects and advantages are achieved by providing a light-emitting device which, according to one embodiment of the present invention, includes a plurality of sub-pixels formed in areas of crossed data lines and scan lines, a precharge controlling circuit, and a precharge circuit. The precharge controlling circuit transmits a precharge controlling signal in accordance with display data inputted from an external source. The precharge circuit applies a precharge current corresponding to display data and resistance of the scan line to the data lines in accordance with the precharge controlling signal transmitted from the precharge controlling circuit.

Preferably, the amount of the precharge current equals the amount of current corresponding to the sum of a cathode voltage of pixel and a voltage corresponding to the display data.

Additionally, the light-emitting device may include a scan driving circuit for transmitting scan signals to the scan lines in one direction.

According to a variation, the light-emitting device may include a first scan driving circuit for transmitting first scan signals to a part of the scan lines and a second scan driving circuit for transmitting second scan signals to the other scan lines.

The precharge circuit may include a digital-analog converter (DAC).

Additionally, the precharge controlling circuit may store the scan line resistance, and calculate an amount of the precharge current through the scan line resistance and the display data.

In accordance with another embodiment, the present invention provides a light-emitting device having a plurality of sub-pixels formed in areas of crossed data lines and scan lines, a data converting circuit, and a data driving circuit. The data converting circuit converts display data inputted from the outside into conversion data corresponding to a resistance of the scan line. The data driving circuit applies data current corresponding to the conversion data transmitted from the data converting circuit to the data lines.

Additionally, the light-emitting device may include a discharge circuit for discharging the data lines to a certain discharge voltage.

According to one variation, the light-emitting device may include a discharge circuit for discharging the data lines to a discharge level corresponding to the conversion data. Such a discharge circuit may include a D/A converter for outputting a level voltage corresponding to the conversion data, and a buffer for buffering the level voltage output from the D/A converter to generate a discharge voltage.

Additionally, the data converting circuit may include a calculating circuit for calculating a cathode voltage of the pixel corresponding to the display data, and a look-up circuit for transmitting conversion data corresponding to the calculated cathode voltage to the data driving circuit.

Additionally, the light-emitting device may include a precharge circuit for applying a precharge current corresponding to the display data to the data lines, and a controlling circuit for controlling operation of the data converting circuit, the data driving circuit, and the precharge circuit.

A method of driving a light-emitting device having a plurality of sub-pixels formed in areas of crossed data lines and scan lines according to one embodiment of the present invention includes: calculating an amount of precharge current using display data input from an external source and a resistance of the scan line (scan line resistance), and applying precharge current based on the calculated amount to the data lines. Preferably, the amount of the precharge current equals the amount of current corresponding to the sum of a cathode voltage of sub-pixel and a voltage corresponding to the display data.

In accordance with another embodiment, the present invention provides a method of driving a light-emitting device including sub-pixels formed in areas of crossed data lines and scan lines includes: converting display data input from an external source into conversion data corresponding to a resistance of the scan line (scan line resistance), and applying data current corresponding to the conversion data to the data lines.

Additionally, the method may include discharging the data lines to a discharge level corresponding to the conversion data. The data lines may be discharged by outputting a level voltage corresponding to the conversion data and buffering the outputted level voltage to generate a discharge voltage.

Additionally, the converting the display data may include calculating a cathode voltage of sub-pixel corresponding to the display data and generating the conversion data corresponding to the calculated cathode voltage. The generated conversion data may correspond to the cathode voltage of data stored in a look-up table.

As described above, in a light-emitting device and a method of driving the same according to the present invention, a precharge current is applied to data lines based on the cathode voltage of pixels (or sub-pixels) and thus a cross-talk phenomenon is avoided in the panel. In addition, according to another embodiment, data current is applied to data lines based on the cathode voltage of pixels and thus cross-talk phenomenon is avoided in the panel.

Additional objects, advantages, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The invention will be described in detail with reference to the following drawings in which like reference numerals refer to like elements wherein.

DETAILED DESCRIPTION OF EMBODIMENTS AND/OR BEST MODE

Figure 1:
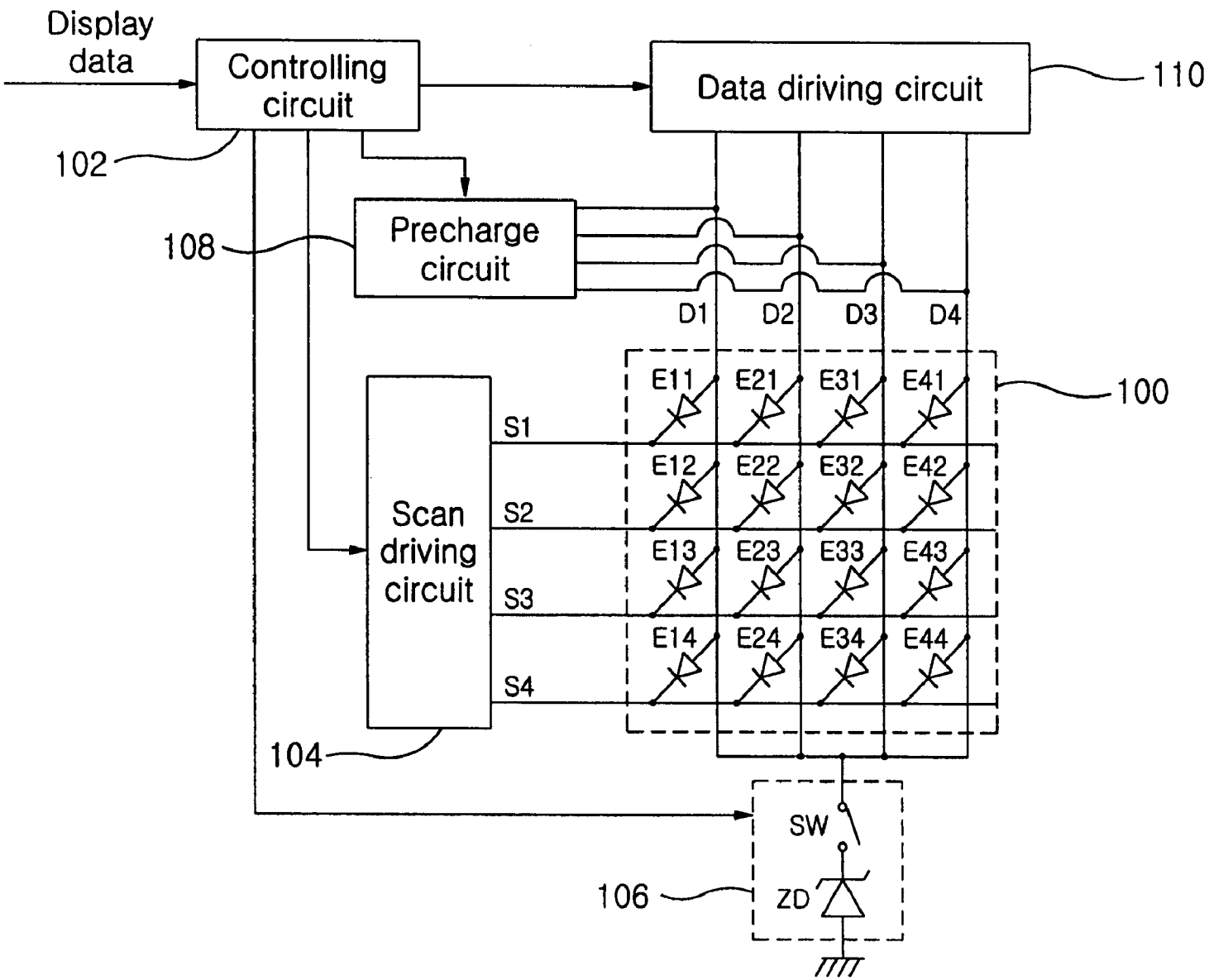
FIG. 1 is a diagram showing first related-art light-emitting device.
Figure 2A:
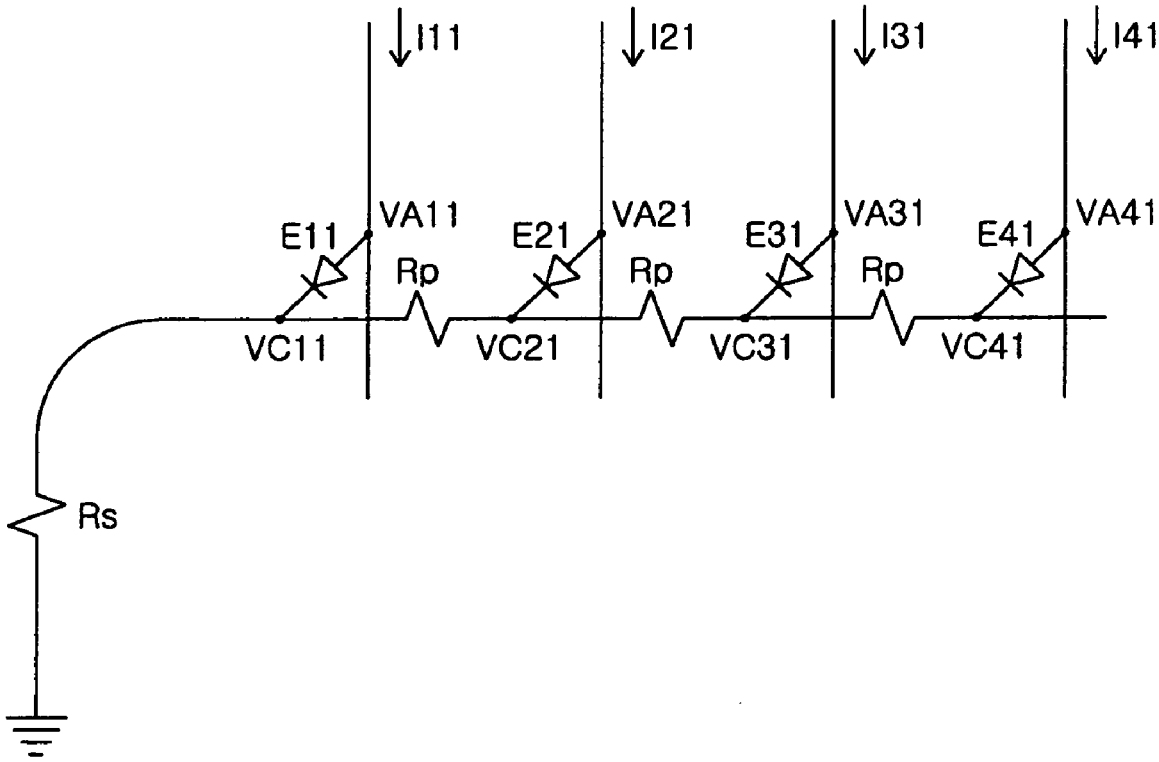
FIG. 2A and FIG. 2B are diagrams of circuits used in a process of driving the light-emitting device of FIG. 1.
Figure 2B:
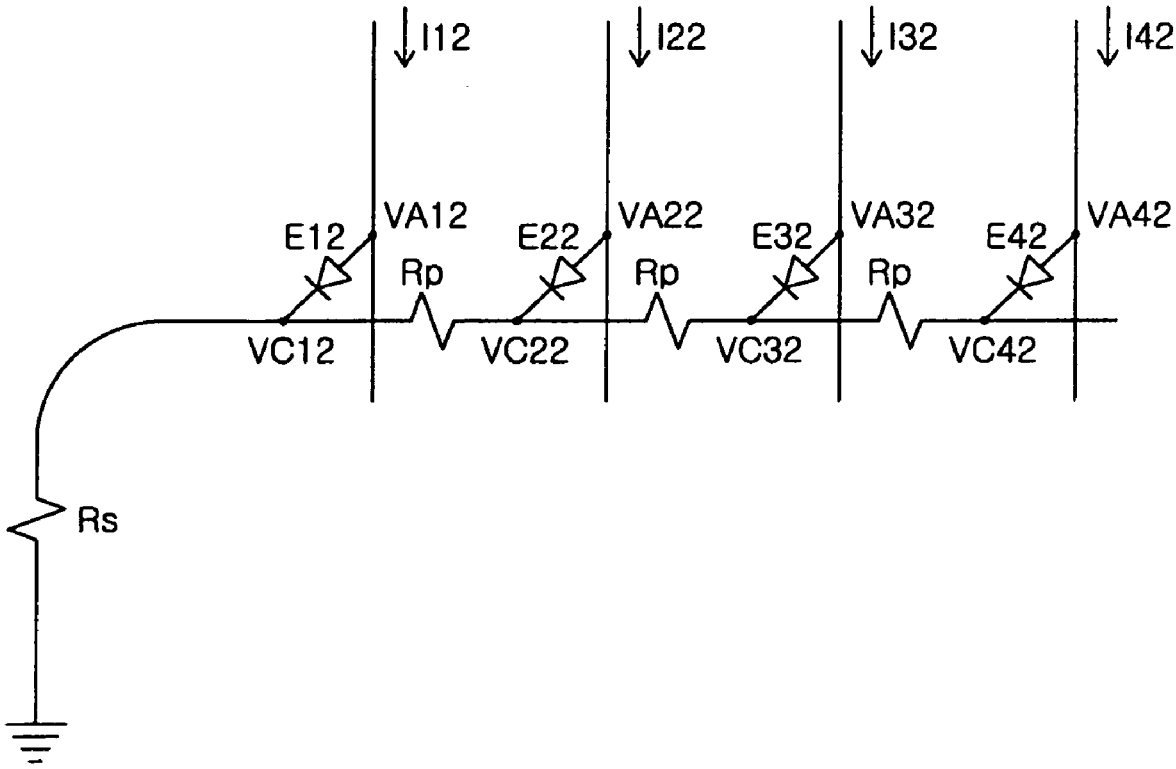
Figure 2C:
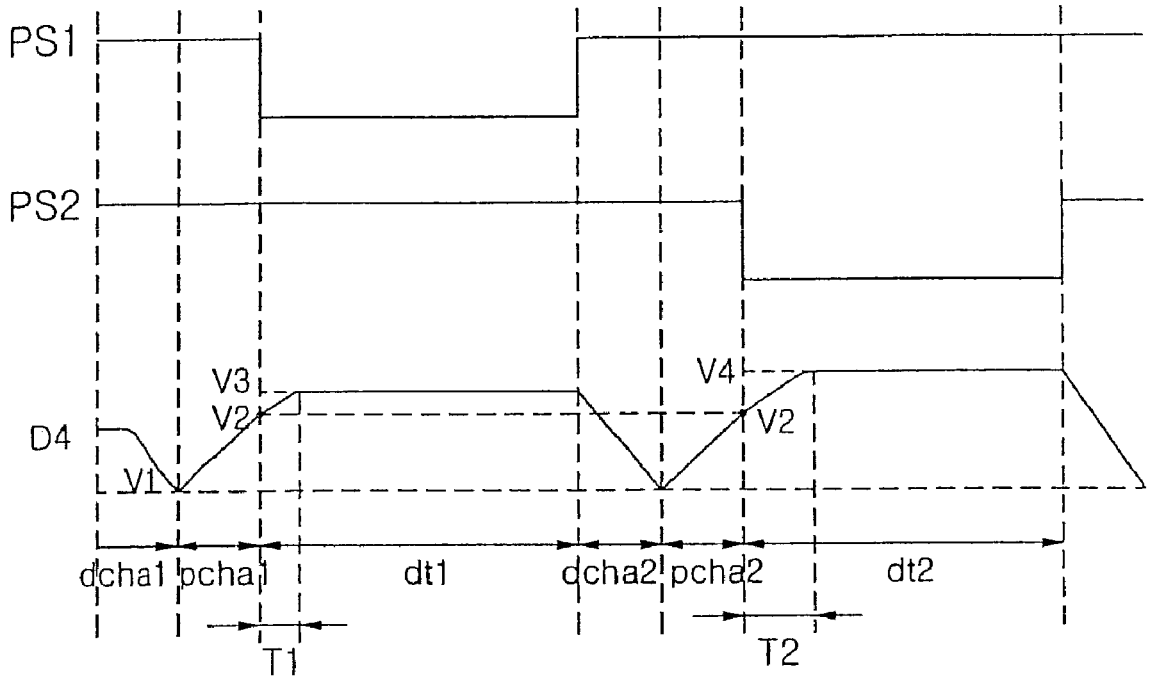
FIG. 2C is a timing diagram showing a light-emitting process of the pixels of FIG. 2A and FIG. 2B.
Figure 3:
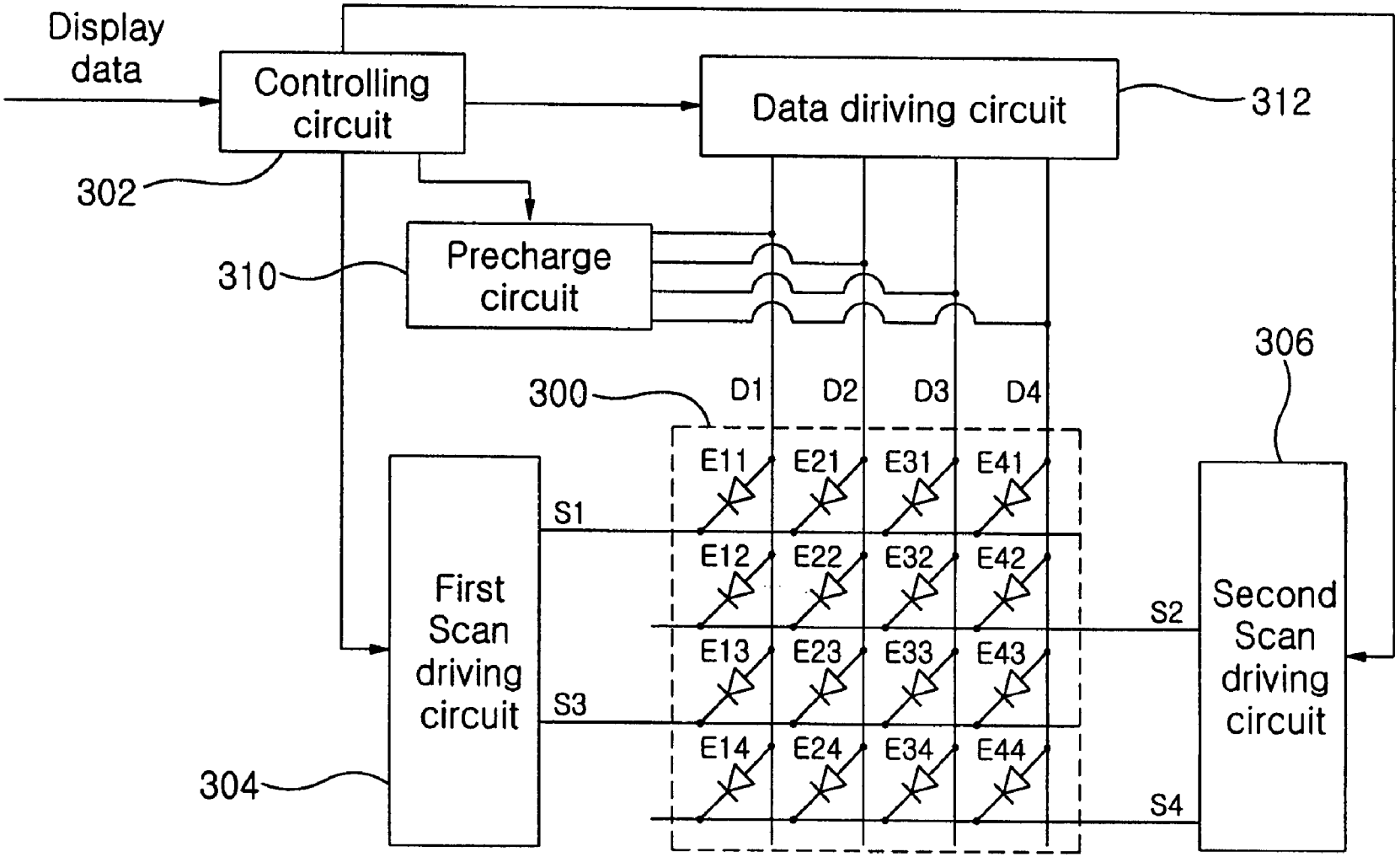
FIG. 3 is a diagram showing a second related-art light-emitting device.
Figure 4:
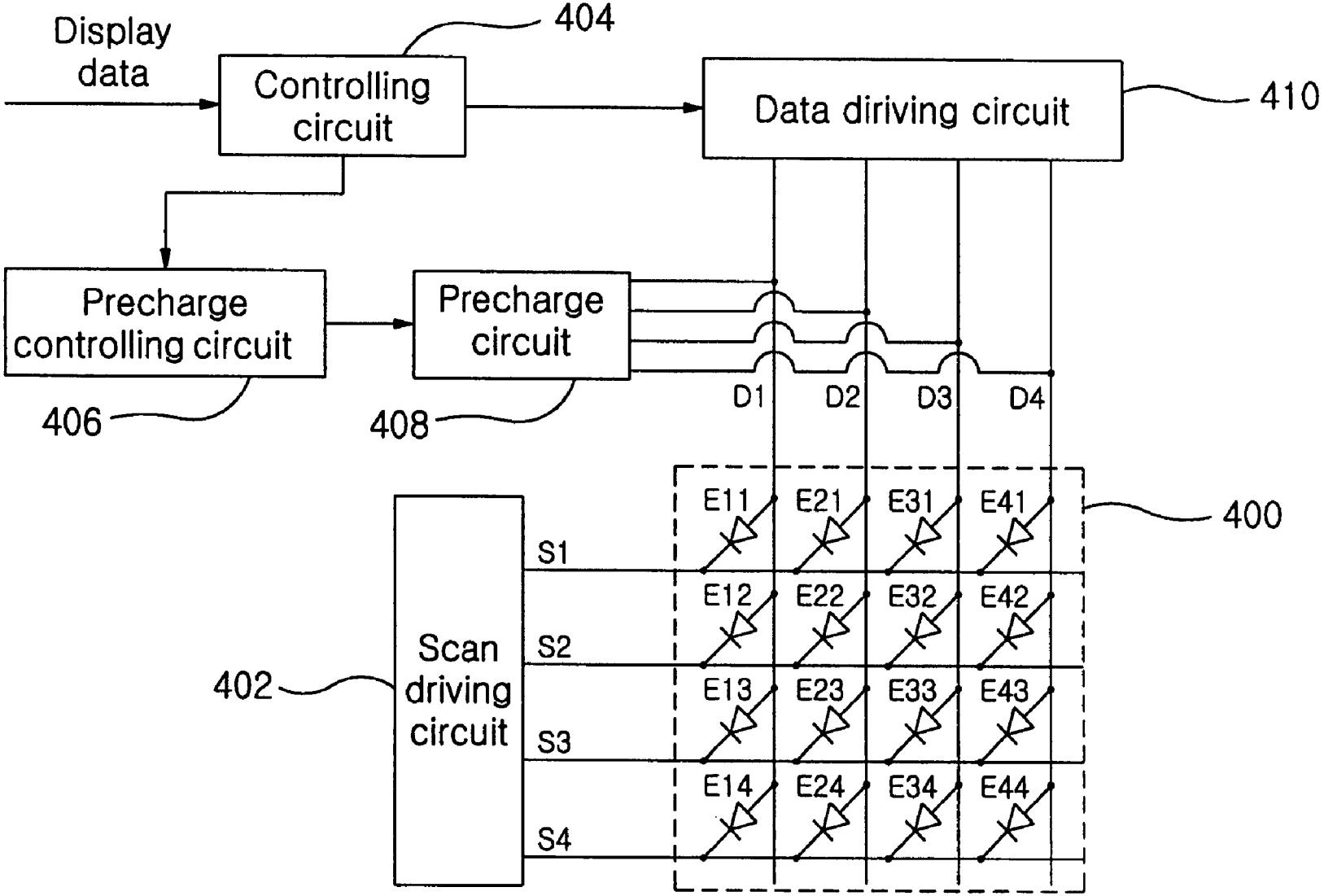
FIG. 4 is a diagram of a light-emitting device according to a first embodiment of the present invention.

FIG. 4 is a diagram of a light-emitting device, preferably an organic electroluminescent device, according to a first embodiment of the present invention. This device includes a panel 400, a scan driving circuit 402, a controlling circuit 404, a precharge controlling circuit 406, a precharge circuit 408, and a data driving circuit 410. The panel 400 includes a plurality of sub-pixels (E11 to E44) formed in areas of crossed data lines (D1 to D4) and scan lines (S1 to S4). The scan driving circuit 402 is formed along one side of the panel and transmits, preferably in sequence, scan signals to the scan lines (S1 to S4).

The controlling circuit 404 stores display data input from an external source. This data may, for example, from the RGB data. The controlling circuit 404 controls operation of the scan driving circuit 402, precharge controlling circuit 406, precharge circuit 408, and data driving circuit 410 using the stored display data. The precharge controlling circuit 406 calculates the amount of precharge current to be applied to the data lines (D1 to D4) under control of the controlling circuit 406, and transmits a precharge controlling signal having information of the calculated amount to the precharge circuit 408.

The precharge circuit 408 applies the precharge current corresponding to the calculated amount to the data lines (D1 to D4) in accordance with the precharge controlling signal transmitted from the precharge controlling circuit 406. The precharge circuit 408, according to one embodiment of the present invention, includes a digital-analog converter (DAC) and generates the precharge current having one of multi-levels by using the DAC. The data driving circuit 410 applies a data current corresponding to the display data transmitted from the controlling circuit 404 to the data lines (D1 to D4). As a result, the sub-pixels (E11 to E44) emit a light having a certain wavelength.

Figure 5A:
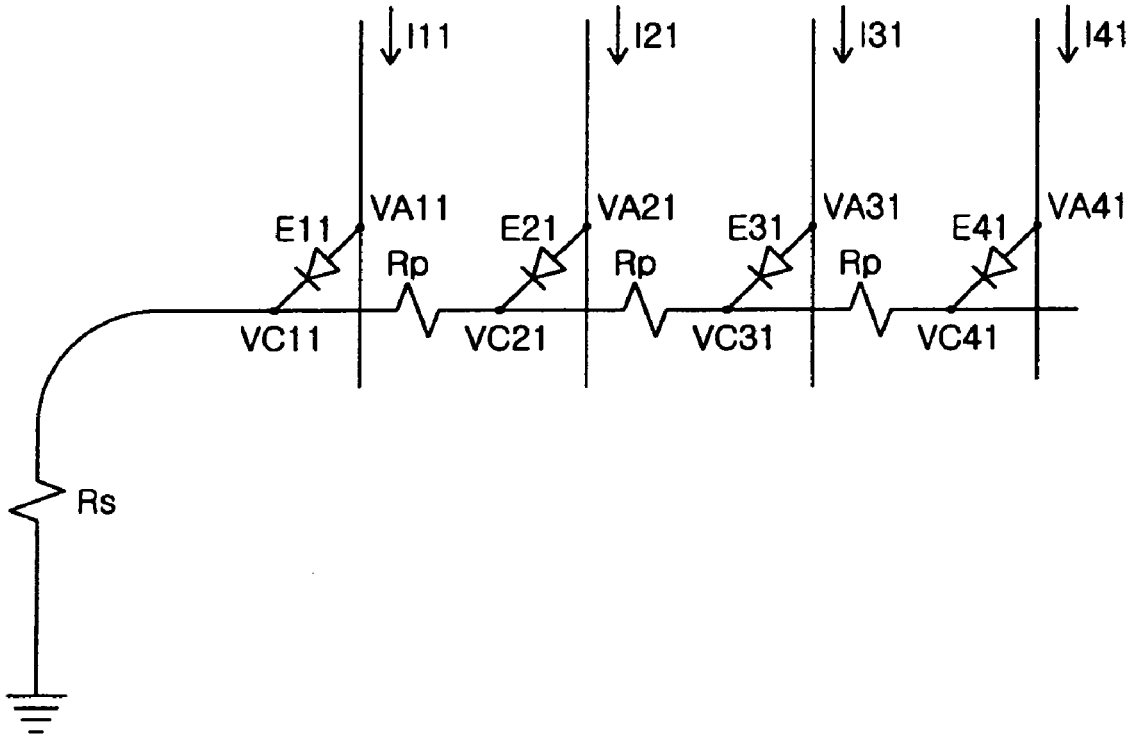
FIG. 5A is a circuit view relating to a process of driving the light-emitting device of FIG. 4 according to one embodiment of the present invention.
Figure 5B:
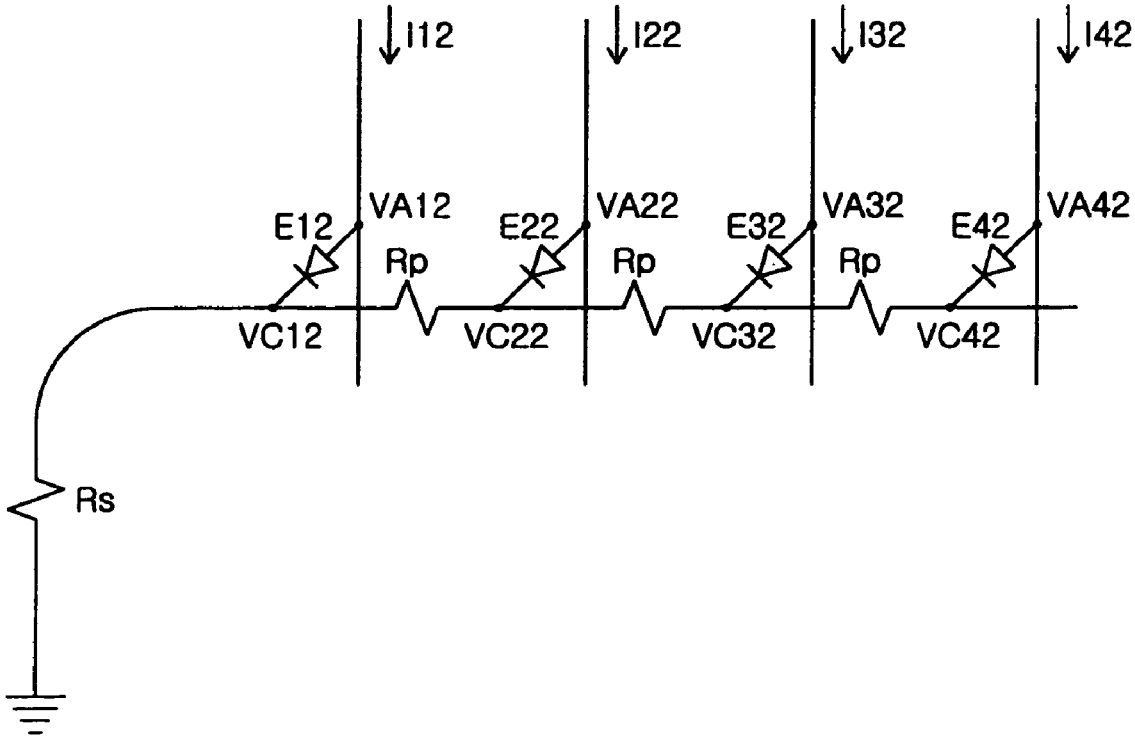
FIG. 5B is a circuit view relating to a process of driving the light-emitting device of FIG. 4 according to another embodiment of the present invention.
Figure 5C:
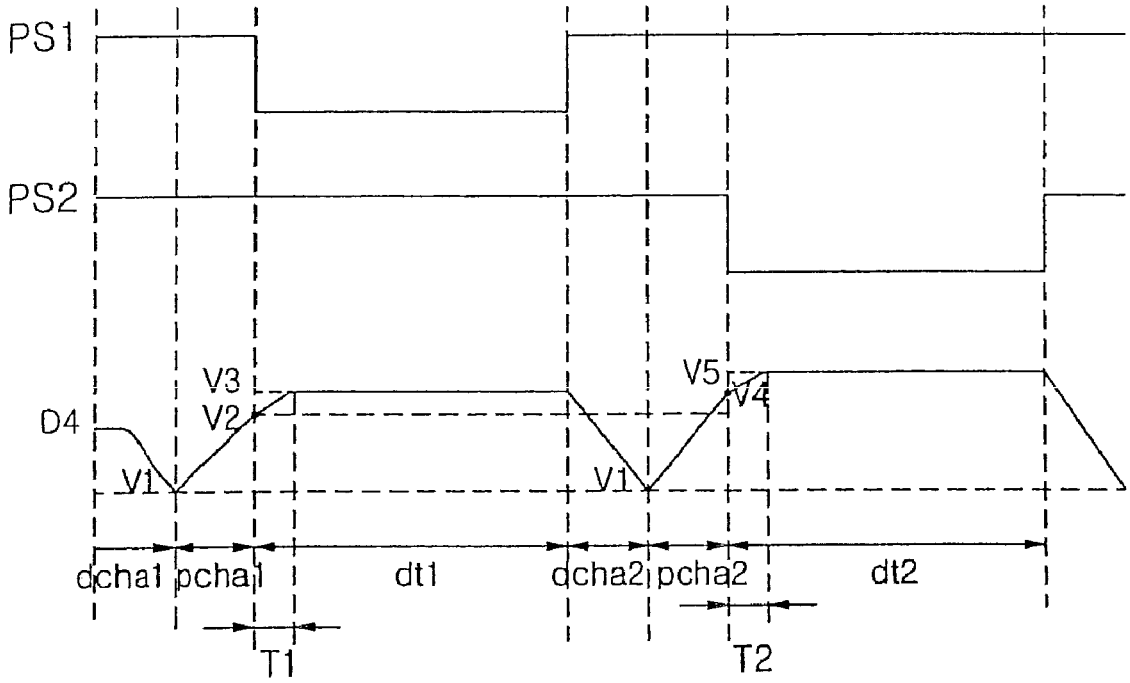
FIG. 5C is a timing diagram relating to the light-emitting process in FIG. 5A and FIG. 5B.

FIG. 5A is a circuit view relating to a process of driving the light-emitting device of FIG. 4 according to one embodiment of the present invention. FIG. 5B is a circuit view relating to a process of driving the light-emitting device of FIG. 4 according to another embodiment of the present invention, and FIG. 5C is a timing diagram relating to the light-emitting process in FIG. 5A and FIG. 5B. A first resistance (RS) between one sub-pixel and ground is assumed to have a predetermined value. For illustrative purposes, this value may be 10Ω. Also, the aforementioned sub-pixel will be assumed to be the outermost pixel, however another sub-pixel may alternatively be used in accordance with the present invention.

Additionally, a second resistor (RP) between sub-pixels is assumed to have a predetermined value, e.g., 2Ω. Each of sub-pixel (E41) and sub-pixel (E42) emits light having a brightness corresponding to a predetermined data current, e.g., 3 amps. Non-selected sub-pixels (E11, E21 and E31) do not emit light. In addition, each of sub-pixels (E12, E22 and E32) emits light having a brightness corresponding to a predetermined data current, e.g., 1 amp.

A process of controlling sub-pixels (E11 to E41) to emit light along first scan line (S1) will now be described. Referring to FIG. 5A, the precharge controlling circuit 406 calculates a cathode voltage (VC41) using information relating to resistors (RS and RP) stored therein and the display data transmitted from the controlling circuit 404. In other words, the precharge controlling circuit 406 detects the magnitude of data currents (I11 to I41) through the display data. Here, each of the detected data currents (I11 to I41) may have the following non-limiting values, respectively: 0, 0, 0 and 3 amps. Subsequently, the precharge controlling circuit 406 calculates the cathode voltage (VC41, e.g., 48V) which is the whole current (sum of 0, 0, 0 and 3A) times a resistance of the scan line (sum of 10, 2, 2 and 2Ω; hereinafter referred to as "scan line resistance").

Then, the precharge controlling circuit 406 transmits a precharge controlling signal having information relating to the calculated cathode voltage (VC41) to the precharge circuit 408. Subsequently, the precharge circuit 408 applies a precharge current to sub-pixel (E41) through the fourth data line (D4) during a first precharge time (pcha1) in accordance with the transmitted precharge controlling signal. As a result, a charge corresponding to the sum (49V) of the cathode voltage (VC41, e.g., 48V) and default precharge current (for example, 1V) is precharged to the sub-pixel (E41). Here, the default precharge current may be related to a voltage corresponding to a precharge current in case the cathode voltage (VC41) and data current are 0V and 3A, respectively.

Then, the data driving circuit 410 applies data currents (I11 to I41) corresponding to the display data transmitted from the controlling circuit 404 to the data lines (D1 to D4) during low logic time of a first scan signal (PS1). As a result, an anode voltage (VA41) of sub-pixel (E41) is stabilized as 52V (e.g., saturation voltage) after T1 time from finish of the precharge, as shown in FIG. 5C. Accordingly, the sub-pixel (E41) emits light having gray scale level corresponding to 4V (52V-48V).

A light-emitting process of sub-pixels (E12 to E42) corresponding to second scan line (S2) will now be described. Referring to FIG. 5B, the precharge controlling circuit 406 calculates a cathode voltage (VC42) using information based on resistors (RS and RP) stored therein and the display data transmitted from the controlling circuit 404. In other words, the precharge controlling circuit 406 detects the magnitude of data currents (I12 to I42) through the display data. Here, the detected data currents (I12 to I42) may be, for example, 1, 1, 1 and 3A respectively. Subsequently, the precharge controlling circuit 406 calculates the cathode voltage (VC42, e.g., 96V) which is the whole current (sum of 1, 1, 1 and 3A) times the scan line resistance (sum of 10, 2, 2 and 2Ω).

Then, the precharge controlling circuit 406 transmits a precharge controlling signal having information concerning the calculated cathode voltage (VC42) to the precharge circuit 408. Subsequently, the precharge circuit 408 applies a precharge current to sub-pixel (E42) through the fourth data line (D4) during a second precharge time (pcha2) in accordance with the transmitted precharge controlling signal. As a result, a charge corresponding to the sum (97V) of the cathode voltage (VC42, e.g., 96V) and default precharge current (for example, 1V) is precharged to sub-pixel (E42). Here, the default precharge current may relate to a voltage corresponding to a precharge current in case the cathode voltage (VC42) and data current are 0V and 3A respectively.

Then, the data driving circuit 410 applies data currents (I12 to I42) corresponding to the display data transmitted from the controlling circuit 404 to the data lines (D1 to D4) during low logic time of a second scan signal (PS2). Here, the cathode voltage (VC42) is 96V, and thus the anode voltage (VA42) should be augmented up to 100V as shown in FIG. 5C, so that sub-pixel (E42) emits light having gray scale level corresponding to 4V. In this case, since a precharge voltage (V4) corresponding to sub-pixel (E42) is 97V, the anode voltage (VA42) is stabilized (e.g., reaches saturation voltage) after an increase of 3V. Accordingly, as in sub-pixel (E41), the anode voltage (VA42) is stabilized (e.g., reaches saturation voltage) after a T1 time from the finish of the precharge.

In summary, in the light-emitting device of the present invention, sub-pixel (E41) and sub-pixel (E42) are stabilized (e.g., reach saturation or stabilization voltage) after a time T1 taken from the finish of the precharge. Hence, in the light-emitting device of the present invention, the consumed amount of charge during dtl time is identical to that during dt2 time, unlike the related-art. Accordingly, sub-pixel (E41) and sub-pixel (E42) have identical brightnesses, and therefore a cross-talk phenomenon does not occur in the light-emitting device of the present invention.

Figure 6:
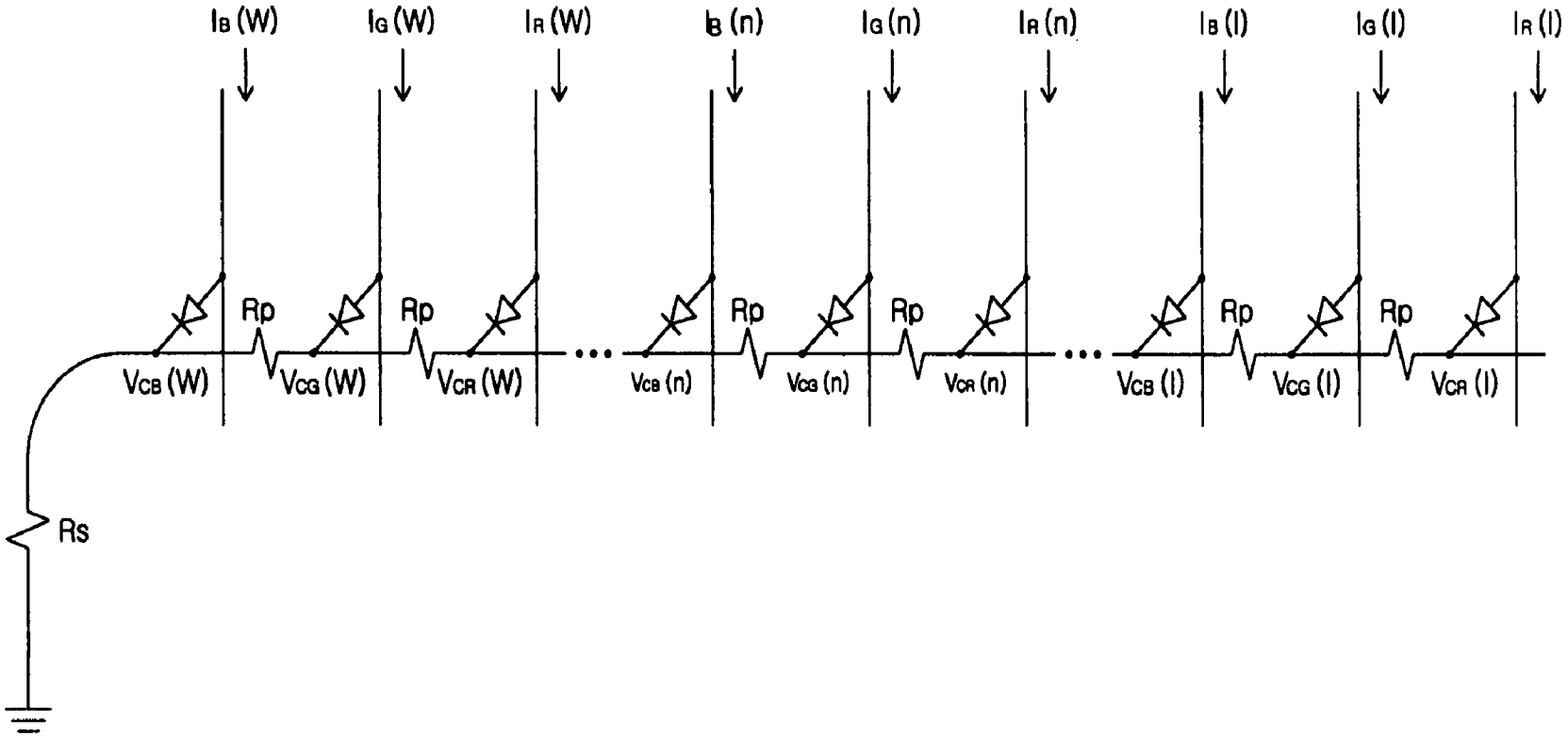
FIG. 6 is a circuit view relating to a light-emitting process of the light emitting device of FIG. 4 according to another embodiment of the present invention.

FIG. 6 is a circuit view relating to a light-emitting process performed for the light emitting device of FIG. 4 according to another embodiment of the present invention. Here, the precharge voltage will be generalized with FIG. 6.

The following preferably sets forth the precharge voltages:

(1) a first precharge voltage ($V_{PRE\text{-}CHARGE\text{-}RED}(n)$) corresponding to red light may be given by $V_{CR}(n)+V_{default\text{-}precharge\text{-}red}(DR(n))$;

(2) a second precharge voltage ($V_{PRE\text{-}CHARGE\text{-}GREEN}(n)$) corresponding to green light may be given by $V_{CG}(n)+V_{default\text{-}precharge\text{-}green}(DR(n))$; and (3) a third precharge voltage ($V_{PRE\text{-}CHARGE\text{-}blue}(n)$) corresponding to blue light may be given by $V_{CG}(n)+V_{default\text{-}precharge\text{-}blue}(DR(n))$.

Here, $V_{CR}(n)$, $V_{CG}(n)$ and $V_{CB}(n)$ are cathode voltages corresponding to red, green and blue sub-pixel, respectively. Also, $V_{default\text{-}precharge\text{-}red}(DR(n))$, $V_{default\text{-}precharge\text{-}green}(DR(n))$ and $V_{default\text{-}precharge\text{-}blue}(DR(n))$ are precharge voltages corresponding to red, green and blue display data, respectively, in case the cathode voltage is 0V. In other words, the light-emitting device of the present invention applies the precharge current to the data lines (D1 to D4) according to the cathode voltage. A method of calculating the cathode voltage is described through the examples in FIG. 5A to FIG. 5C.

A light-emitting device, according to another embodiment of the present invention, is plasma display panel (PDP) or liquid crystal display (LCD) in which a precharge current is applied to data lines according to an electrode voltage for a cell.

Figure 7:
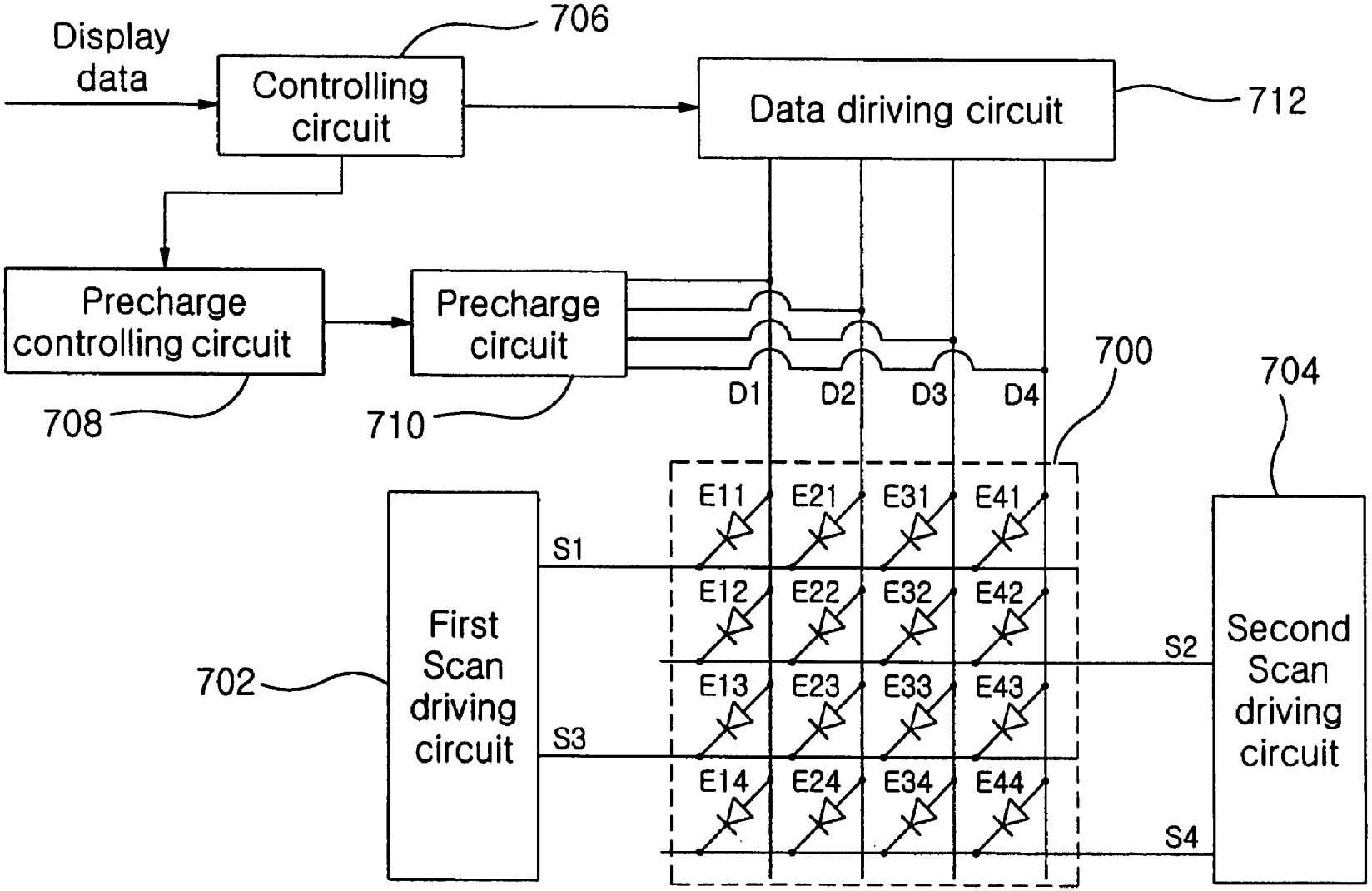
FIG. 7 is a diagram of a light-emitting device according to a second embodiment of the present invention.

FIG. 7 is a diagram of a light-emitting device, preferably an organic electroluminescent device, according to a second embodiment of the present invention. This device includes a panel 700, a first scan driving circuit 702, a second scan driving circuit 704, a controlling circuit 706, a precharge controlling circuit 708, a precharge circuit 710, and a data driving circuit 712. The elements of this embodiment, except the first scan driving circuit 702 and the second scan driving circuit 704, is preferably the same as those in the first embodiment.

In operation, the first scan driving circuit 702 provides first scan signals to one part (S1 and S3) of scan lines (S1 to S4) along one side or direction of the panel 700. The second scan driving circuit 704 provides second scan signals to the other scan lines (S2 and S4) along another side or direction of the panel 700.

As in the first embodiment, a precharge current may be applied to data lines (D1 to D4) according to a cathode voltage in the second embodiment. Also, the light-emitting process in the second embodiment may be similar to that in the first embodiment.

Figure 8:
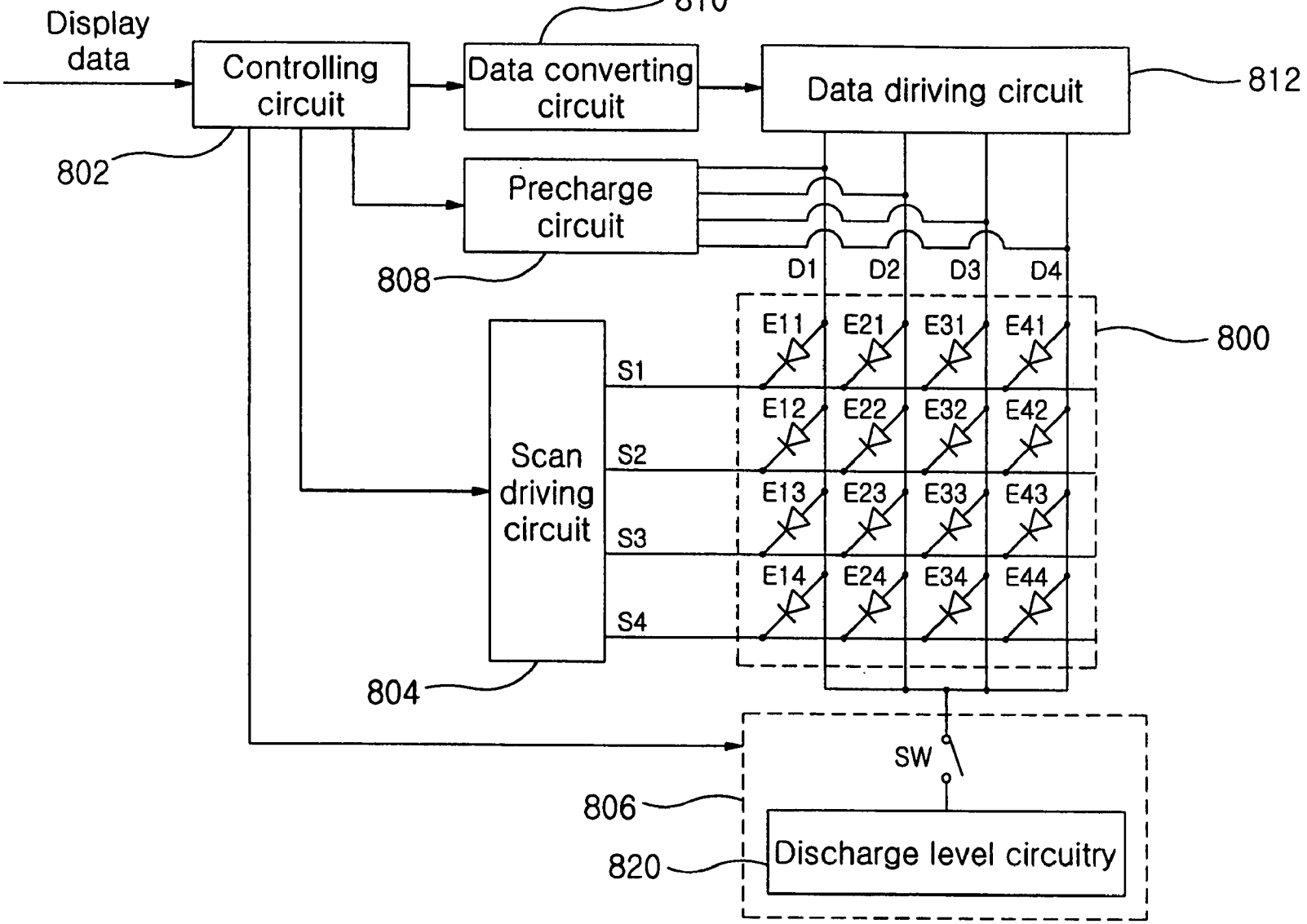
FIG. 8 is a diagram of a light-emitting device according to a third embodiment of the present invention.

FIG. 8 is a diagram of a light-emitting device, preferably an organic electroluminescent device, according to a third embodiment of the present invention. This device includes a panel 800, a controlling circuit 802, a scan driving circuit 804, a discharge circuit 806, a precharge circuit 808, a data converting circuit 810 and a data driving circuit 812. The panel 800 includes a plurality of sub-pixels (E11 to E44) formed in areas of crossed data lines (D1 to D4) and scan lines (S1 to S4).

The controlling circuit 802 receives display data input from an external source, and controls operation of the elements in the light-emitting device. The display data may, for example, be RGB data. The scan driving circuit 804 is formed along one side or direction of the panel 800 and transmits, preferably in sequence, scan signals to the scan lines (S1 to S4) under control of the controlling circuit 802. In other words, the scan driving circuit 804 may connect in sequence the scan lines (S1 to S4) to ground.

The discharge circuit 806 includes a switch (SW) and a discharge level circuitry 820. The switch (SW) is turned on or off under control of the controlling circuit 802. For example, the switch (SW) is turned on when data lines (D1 to D4) are discharged. As a result, data lines (D1 to D4) are connected to the discharge level circuitry 820, and so a charge charged to the data lines (D1 to D4) is discharged to a certain level. The precharge circuit 808 applies a precharge current corresponding to the display data to data lines (D1 to D4) under control of the controlling circuit 802.

The data converting circuit 810 converts the display data into conversion data corresponding to cathode voltages of sub-pixels (E11 to E44) under control of the controlling circuit 802. In other words, since the cathode voltages of sub-pixels (E11 to E44) are affected by the scan line resistance of each of scan lines (S1 to S4), the data converting circuit 810 converts the display data into the conversion data in order to compensate the scan line resistance. In addition, the data converting circuit 810 provides the conversion data to the data driving circuit 812. The data driving circuit 812 provides data current corresponding to the conversion data to the data lines (D1 to D4), and so the corresponding pixel to the data current emits a light.

Figure 9:
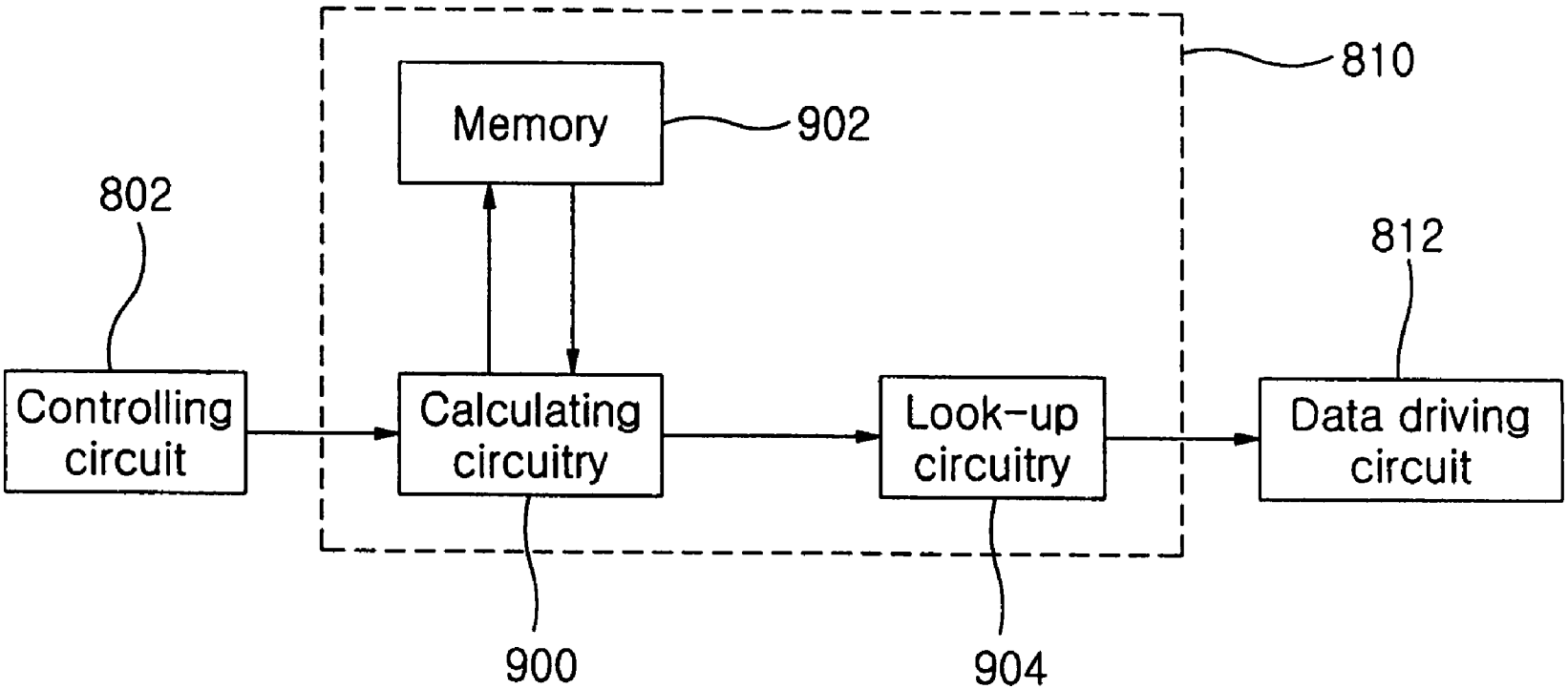
FIG. 9 is a diagram of a data converting circuit that may be included in the device of FIG. 8.

FIG. 9 is a diagram of one type of data converting circuit that may be used in FIG. 8. This data converting circuit 810 includes calculating circuitry 900, a memory 902, and look-up circuitry 904. The memory 902 stores resistances of the scan lines (S1 to S4).

The calculating circuitry 900 calculates a cathode voltage of a pixel corresponding to the scan line, and provides the calculated cathode voltage to the look-up circuitry 904. Here, the cathode voltage is the scan line resistance times a data current corresponding to the display data. The look-up circuitry 904 includes a look-up table having at least one conversion data, and selects one of the conversion data included in the look-up table in accordance with the cathode voltage provided from the calculating circuitry 900. Here, the selected data correspond to the cathode voltage.

Then, the look-up circuitry 904 provides the selected conversion data to the data driving circuit 812. Here, the selected conversion data may not be precisely identical to the cathode voltage, and in that case, is most similar to the cathode voltage among the conversion data. Accordingly, the brightness of the pixels designed to emit the same brightness may be different according to scan lines, but such difference is not recognizable to a user of the panel 800.

Figure 10A:
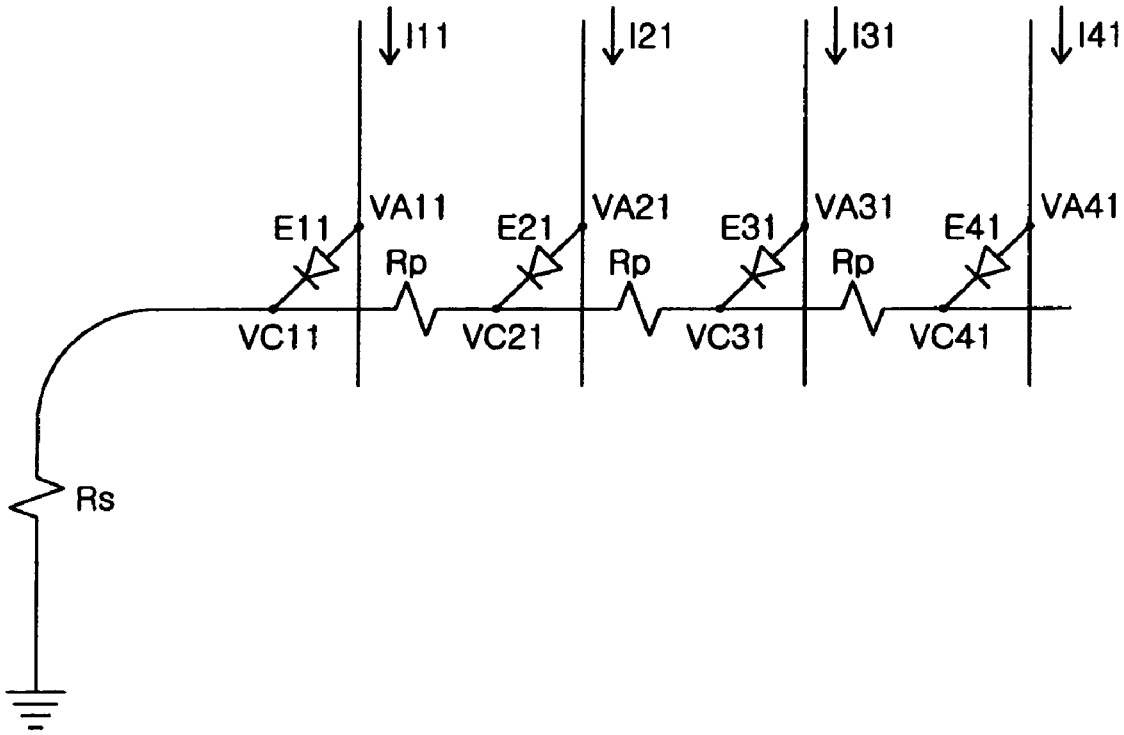
FIG. 10A is a circuit view relating to a process of driving the light-emitting device of FIG. 8 according to one embodiment of the present invention.
Figure 10B:
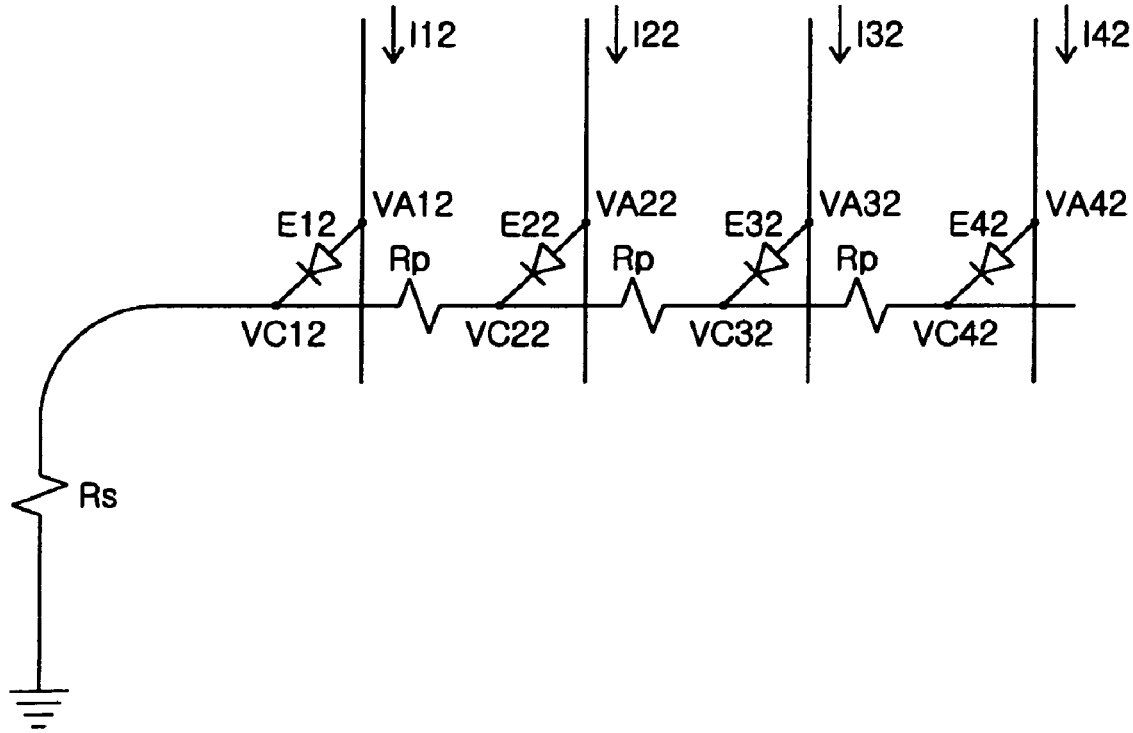
FIG. 10B is a circuit diagram relating to a process of driving the light-emitting device of FIG. 8 according to another embodiment of the present invention.
Figure 10C:
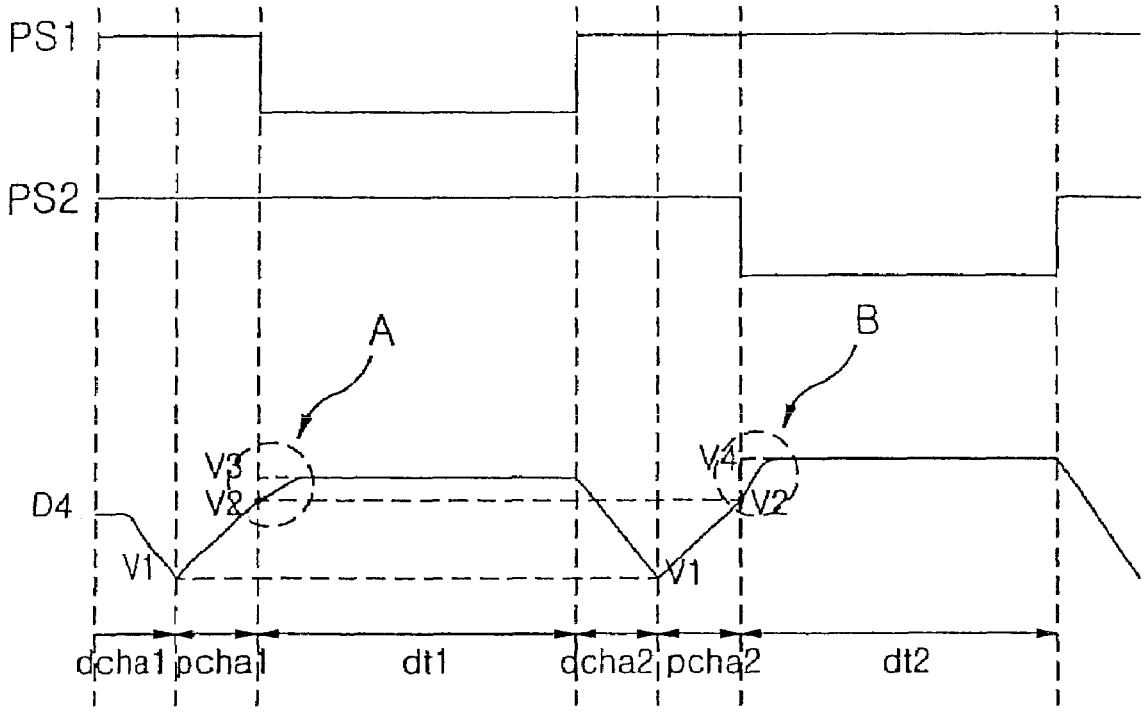
FIG. 10C is a timing diagram relating to light-emitting process associated with FIG. 10A and FIG. 10B.

FIG. 10A is a circuit view relating to a process of driving the light-emitting device of FIG. 8 according to one embodiment of the present invention. FIG. 10B is a circuit diagram relating to a process of driving the light-emitting device of FIG. 8 according to another embodiment of the present invention, and FIG. 10C is a timing diagram relating to light-emitting process associated with FIG. 10A and FIG. 10B. In this circuit, a first resistor (RS) is located between one sub-pixel (e.g., the outermost sub-pixel) and ground and has a predetermined value, e.g., 10Ω. Additionally, a second resistor (RP) between sub-pixels has a predetermined value, e.g., 2Ω. Moreover, each of sub-pixel (E41) and sub-pixel (E42) emits light having brightness based on a predetermined data current, e.g., 3 amps. Further, sub-pixels (E11, E21 and E31) may not emit light under certain circumstances, e.g., based on the video being displayed. In addition, each of sub-pixels (E12, E22 and E32) emit light having brightness corresponding to a data current of, for example, 1 amp.

A process of emitting a light in sub-pixels (E11 to E41) corresponding to a first scan line (S1) will now be described. Referring to FIG. 10A, the precharge circuit 808 applies a precharge current corresponding to the display data to the data lines (D1 to D4). Thus, a charge corresponding to a second voltage (V2) is precharged to data lines (D1 to D4).

Subsequently, calculating circuitry 900 calculates a cathode voltage (VC41) using information based on resistors (RS and RP) stored in memory 902 and the display data transmitted from the controlling circuit 802. In other words, the calculating circuitry 900 detects data currents (I11 to I41) through the display data. Here, each of the detected data currents (I11 to 141) is 0, 0, 0 and 3 amps.

Then, the calculating circuitry 900 calculates the cathode voltage (VC41, e.g., 48V) which is the whole current (sum of 0, 0, 0 and 3A) passing a first scan line (S1) times the scan line resistance (sum of 10, 2, 2 and 2Ω). Subsequently, calculating circuitry 900 transmits a first calculation signal having information of the calculated cathode voltage (VC41) to the look-up circuitry 904. The look-up circuitry 904 then selects conversion data corresponding to the cathode voltage (VC41) in the look-up table and provides the selected conversion data to the data driving circuit 812.

The data driving circuit 812 provides data currents (I11 to I41), corresponding to the conversion data provided from the look-up circuitry 904, to the data lines (D1 to D4) during low logic time of a first scan signal (PS1). As a result, an anode voltage (VA41) of the sub-pixel (E41) is stabilized to V3 (e.g., reaches saturation voltage) after a certain time measured from the finish of the precharge, as shown in FIG. 10C. In case the voltage corresponding to 3A is 4V, the anode voltage (VA41) of sub-pixel (E41) is stabilized to 52V, each reaches saturation voltage. Accordingly, the sub-pixel (E41) may emit a light having a gray scale level corresponding to 4V (52V-48V).

A light-emitting process of sub-pixels (E12 to E42) corresponding to a second scan line (S2) will now be described. Referring to FIG. 10B, the precharge circuit 808 applies a precharge current corresponding to the display data to data lines (D1 to D4), and thus a charge corresponding to the second voltage (V2) is precharged to data lines (D1 to D4). Subsequently, the calculating circuitry 900 calculates a cathode voltage (VC42) using information based on resistors (RS and RP) stored in the memory 902 and the display data transmitted from the controlling circuit 802. In other words, the calculating circuitry 900 detects data currents (I12 to I42) through the display data. Here, each of the detected data currents (I12 to 142) may be 1, 1, 1 and 3 amps.

The calculating circuitry 900 calculates the cathode voltage (VC42, e.g., 96V) which is the whole current (sum of 1, 1, 1 and 3A) passing a second scan line (S2) times the scan line resistance (sum of 10, 2, 2 and 2Ω). Subsequently, circuitry 900 provides a second calculation signal having information concerning the calculated cathode voltage (VC42) to the look-up circuitry 904. The look-up circuitry 904 selects conversion data corresponding to the cathode voltage (VC42) in the look-up circuitry, and then transmits the selected conversion data to the data driving circuit 812.

The data driving circuit 812 applies data currents (I12 to I42) corresponding to the conversion data transmitted from the look-up circuit 904 to the data lines (D1 to D4) during low logic time of a second scan signal (PS2). As a result, an anode voltage (VA42) of sub-pixel (E42) is stabilized to V4 (e.g., reaches saturation voltage) after a certain time measured from the finish of the precharge, as shown in FIG. 10C. In case the voltage corresponding to 3A is 4V, anode voltage (VA42) of pixel (E42) is stabilized to 100V, e.g., reaches saturation voltage. Here, the cathode voltage (VC42) is higher than the cathode voltage (VC41), and thus the data current (I42) higher than the data current (I41) is applied to the fourth data line (D4), as shown in FIG. 10C.

In other words, the slope of data current (I42) as shown in part B is higher than the slope of the data current (I41) as shown in part A. Hence, the consumed amount of charge for stabilizing the data current (I42) in the sub-pixel (E42) is the same as, or similar to, that needed to stabilize the data current (I41) in the sub-pixel (E41).

In summary, in the light-emitting device of the present invention, the slope of the data current is changed in accordance with the cathode voltage of the pixel, and thus any difference of brightness does not occur between pixels designed to emit same brightness. Accordingly, unlike related-art light-emitting devices, a cross-talk phenomenon does not occur on the panel of the present light-emitting device.

Figure 11:
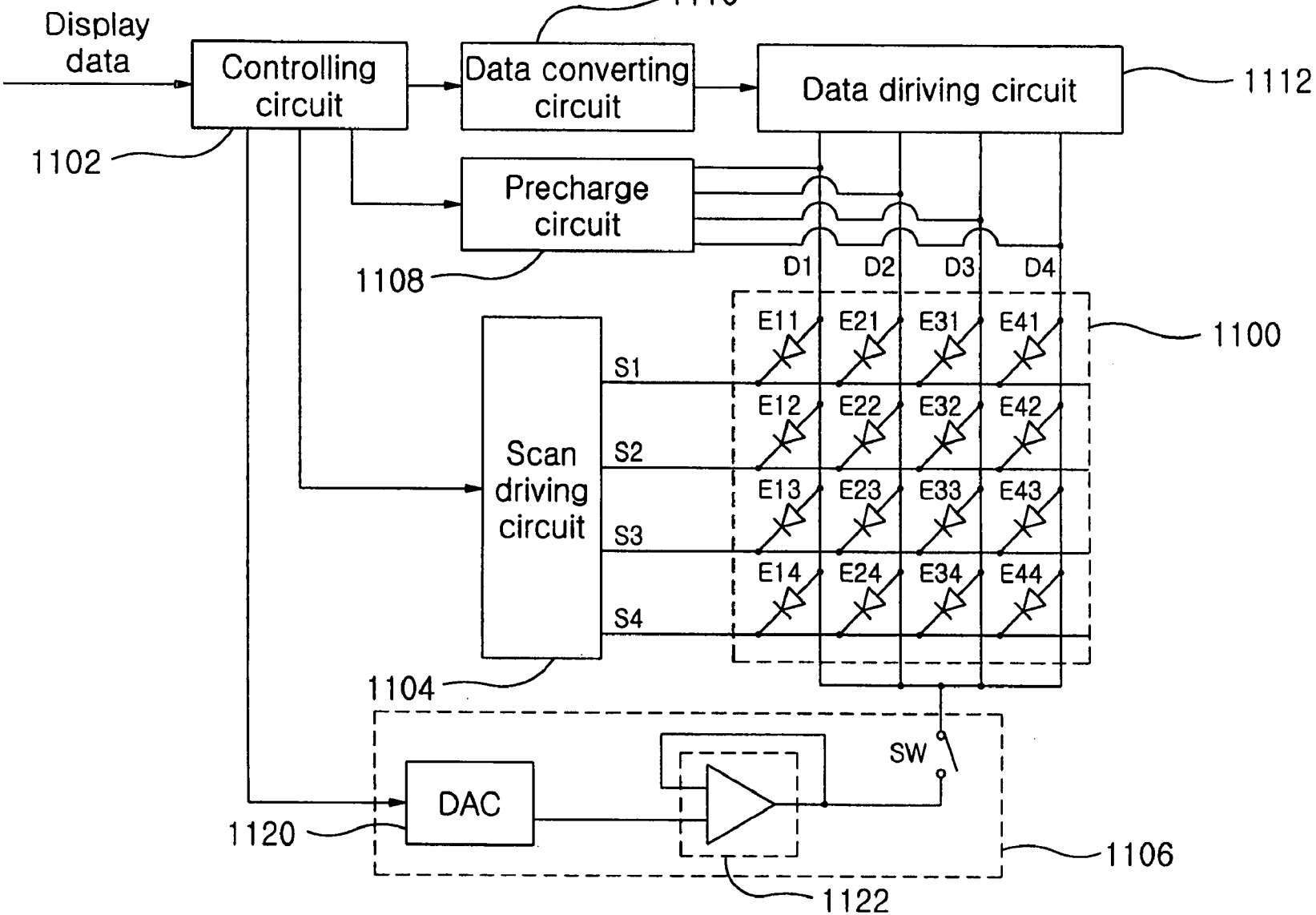
FIG. 11 is a diagram of a light-emitting device according to a fourth embodiment of the present invention.

FIG. 11 is a diagram of a light-emitting device, preferably an organic electroluminescent device, according to a fourth embodiment of the present invention. This device includes a panel 1000, a controlling circuit 1102, a scan driving circuit 1104, a discharge circuit 1106, a precharge circuit 1108, a data converting circuit 1110 and a data driving circuit 1112. The elements of this embodiment, except the discharge circuit 1106, may be the same as those of the third embodiment.

The discharge circuit 1106 includes a switch (SW), a digital-to-analog (D/A) converter 1120, and a buffer 1122. The switch (SW) is turned on during the discharge time. The D/A converter 1120 transmits a first discharge voltage corresponding to one level of a plurality of discharge levels to the buffer 1122 under control of the controlling circuit 1102.

The buffer 1122 buffers the first discharge voltage transmitted from the D/A converter 1120, to output a second discharge voltage of preferably a constant magnitude. As a result, a charge charged to the data lines (D1 to D4) is discharged to the second discharge voltage during the discharge time. In other words, in the fourth embodiment, the discharge circuit 1106 has discharge levels unlike the third embodiment.

In summary, in the light-emitting device of the present invention, data current not precisely identical to the cathode voltage may be applied to the data lines (D1 to D4). In this case, controlling circuit 1106 compensates the non-identical data current by adjusting the discharge voltage to a certain level of unit.

Figure 12:
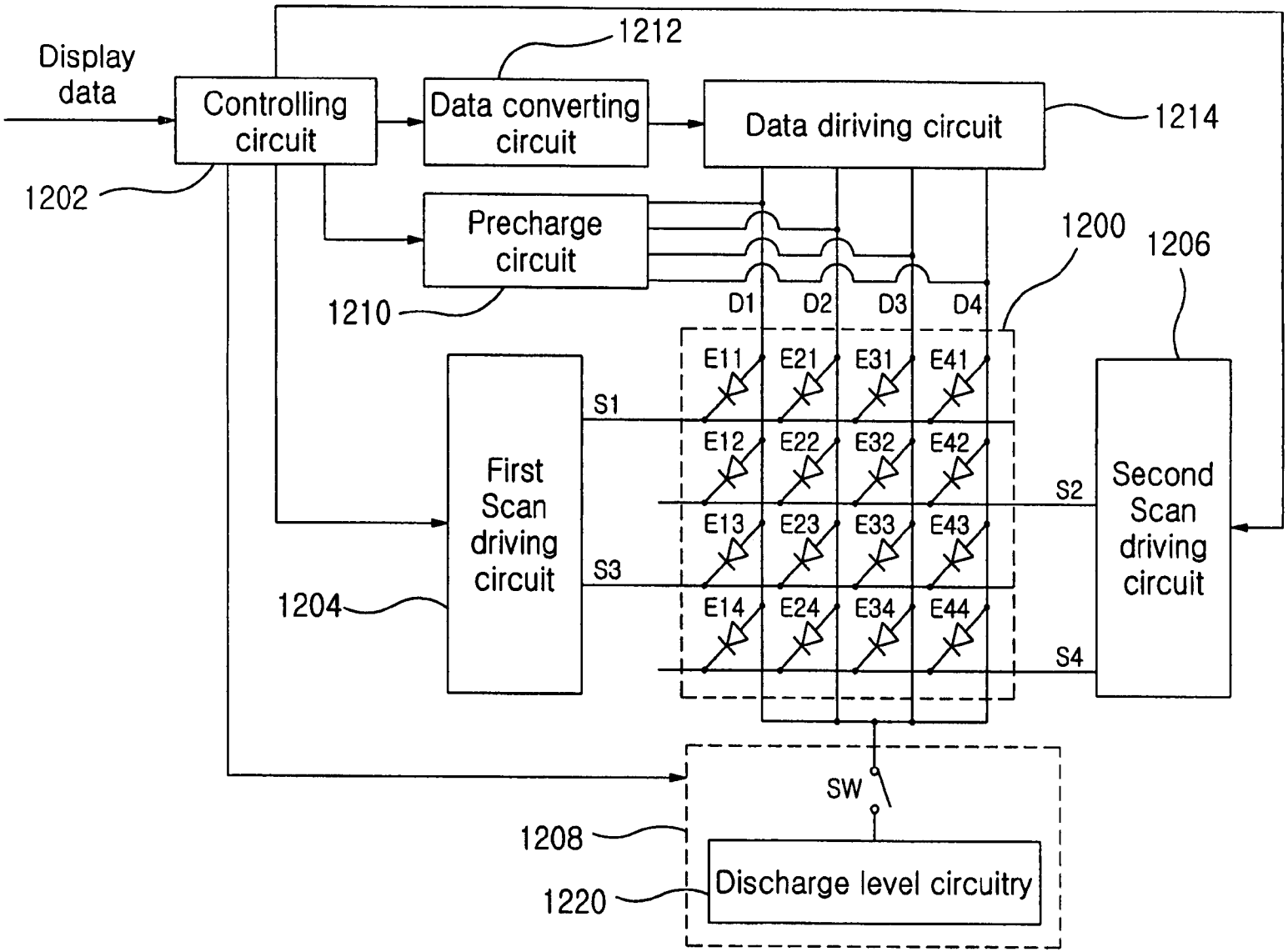
FIG. 12 is a diagram of a light-emitting device according to a fifth embodiment of the present invention.

FIG. 12 is a diagram of a light-emitting device, e.g., an organic electroluminescent device, according to a fifth embodiment of the present invention. This device includes a panel 1200, a controlling circuit 1202, a first scan driving circuit 1204, a second scan driving circuit 1206, a discharge circuit 1208, a precharge circuit 1210, a data converting circuit 1212, and a data driving circuit 1214. The elements of this embodiment, except the first scan driving circuit 1204 and the second scan driving circuit 1206, may be the same as those in the second embodiment.

The first scan driving circuit 1204 provides first scan signals to some (S1 and S3) of the scan lines (S1 to S4) in one direction of the panel 1200. The second scan driving circuit 1206 transmits second scan signals to remaining ones of the scan lines (S2 and S4) in other direction of the panel 1200. Like the third embodiment, data current is applied to data lines (D1 to D4) according to the cathode voltage in the fifth embodiment. The light-emitting process of the fifth embodiment is similar to that of the third embodiment, and thus further detailed descriptions concerning the process will be omitted.

The foregoing embodiments and advantages are merely exemplary and are not to be construed as limiting the present invention. The present teaching can be readily applied to other types of apparatuses. For example, the present invention may be used in or formed as a flexible display for electronic books, newspapers, magazines, etc., different types of portable devices, e.g., handsets, MP3 players, notebook computers, etc., vehicle audio applications, vehicle navigation applications, televisions, monitors, or other types of devices needing a display.

Further, the description of the present invention is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

What is claimed is:

1. An electroluminescent device comprising:

a plurality of scan lines in a first direction;

a plurality of data lines in a second direction, the first direction being different from the second direction; and a plurality of sub-pixels, each sub-pixel including a corresponding scan line and a corresponding data line;

a precharge controlling circuit which transmits a precharge controlling signal based on display data; and a precharge circuit which applies a precharge current corresponding to the display data and a scan line resistance to the data lines based on the precharge controlling signal transmitted from the precharge controlling circuit, wherein, for at least one sub-pixel coupled to a first data line, the first data line is pre-charged to a first voltage for a prescribed gray scale level and for at least one other sub-pixel coupled to the-first data line, the first data line is pre-charged to a second voltage for the prescribed gray scale level, wherein the first and second voltages are different.

2. The device of claim 1, wherein the first data line is pre-charged from a prescribed voltage to the first voltage at a first rate of change, and the first data line is pre-charged from the prescribed voltage to the second voltage at a second rate of change, and wherein the second rate of change is different than the first rate of change.

3. The device of claim 2, wherein the second rate of change is greater than the first rate of change.

4. The device of claim 1, wherein the first data line is pre-charged prior to a display time.

5. The electroluminescent device of claim 1, wherein a voltage on the first data line for the at least one sub-pixel is changed from the first voltage to a first saturation voltage, and a voltage on the first data line for the at least one other sub-pixel is changed from the second voltage to a second saturation voltage, wherein the first saturation voltage is different from the second saturation voltage.

6. The electroluminescent device of claim 5, wherein a first rate of change from the first voltage to the first saturation voltage is the same as a second rate of change from the second voltage to the second saturation voltage.

7. The electroluminescent device of claim 5, wherein the first saturation voltage is reached within a first period of time, and the second saturation voltage is reached within a second period of time, the first and second periods of time being substantially the same.

8. The electroluminescent device of claim 1, wherein the electroluminescent device is an organic electroluminescent device.

9. An electroluminescent device comprising:

a plurality of scan lines in a first direction;

a plurality of data lines in a second direction, the first direction being different from the second direction; and a plurality of sub-pixels, each sub-pixel including a corresponding scan line and a corresponding data line;

a precharge controlling circuit which transmits a precharge controlling signal based on display data; and a precharge circuit which applies a precharge current corresponding to the display data and a scan line resistance to the data lines based on the precharge controlling signal transmitted from the precharge controlling circuit, wherein, for at least one sub-pixel coupled to a corresponding first data line, the first data line is pre-charged to a first voltage and thereafter, from the first voltage to a first saturation voltage for a prescribed gray scale level, and for at least one other sub-pixel coupled to the first data line, the first data line is pre-charged to a second voltage and thereafter, from the second voltage to a second saturation voltage for the prescribed gray scale level, wherein the first saturation voltage is different from the second saturation voltage, and a first rate of change from the first voltage to the first saturation voltage is different from a second rate of change from the second voltage to the second saturation voltage.

10. The electroluminescent device of claim 9, wherein the first saturation voltage is reached within a first period of time, and the second saturation voltage is reached within a second period of time, the first and second periods of time being substantially the same.

11. The electroluminescent device of claim 6, wherein the first and second voltages are the same.

12. The electroluminescent device of claim 2, wherein first data line is pre-charged from the prescribed voltage to the first voltage at the first rate of change during a first time period, and the first data line is pre-charged from the prescribed voltage to the second voltage at a second rate of change during a second time period, and wherein the first time period is at least substantially equal to the second time period.

13. The electroluminescent device of claim 12, the first data line is charged to a first stabilization voltage over a third time period and the second data line is charged to a second stabilization voltage over a fourth time period, wherein third time period is at least substantially equal to the fourth time period and wherein the second stabilization voltage is greater than the first stabilization voltage.

14. The electroluminescent device of claim 13, wherein the second sub-pixel is coupled to a scan line which is selected after a scan line coupled to the first sub-pixel is selected.

15. An electroluminescent device comprising:

a plurality of scan lines in a first direction;

a plurality of data lines in a second direction, the first direction being different from the second direction; and a plurality of sub-pixels, each sub-pixel including a corresponding scan line and a corresponding data line;

a precharge controlling circuit which transmits a precharge controlling signal based on display data; and a precharge circuit which applies a precharge current corresponding to the display data and a scan line resistance to the data lines based on the precharge controlling signal transmitted from the precharge controlling circuit, wherein:

for a first sub-pixel coupled to a first data line, the first data line is pre-charged to a first pre-charge voltage and then to a first stabilization voltage for a prescribed gray scale level, and for a second sub-pixel coupled to the first data line, the first data line is pre-charged to substantially the first pre-charge voltage and then to a second stabilization voltage for the prescribed gray scale level, wherein:

the first data line is pre-charged to the first pre-charge voltage at a first rate for the first and second sub-pixels, the first data line is charged to the first stabilization voltage at a second rate for the first sub-pixel, and the first data line is charged to the second stabilization voltage at a third rate for the second sub-pixel, wherein the first, second, and third rates are different rates.

16. The electroluminescent device of claim 15, wherein the third rate is greater than the first rate, which is greater than the second rate.

17. The electroluminescent device of claim 16, wherein the second stabilization voltage is greater than the first stabilization voltage.

18. The electroluminescent device of claim 17, wherein the second sub-pixel is coupled to a scan line which is selected after a scan line coupled to the first sub-pixel is selected.

* * * * *